US005759117A

United States Patent [19]

Erickson, Jr.

[11] Patent Number: 5,759,117

[45] Date of Patent: Jun. 2, 1998

[54] GOLF BALL AND TEE PLACING DEVICE

[76] Inventor: Charles Emmett Erickson, Jr., 621 7th Ave. SW., Jamestown, N. Dak. 58401

[21] Appl. No.: 679,261

[22] Filed: Jul. 12, 1996

[51] Int. Cl.[6] ..... A63B 57/00

[52] U.S. Cl. ..... 473/386

[58] Field of Search ..... 973/386, 408, 973/406, 132, 285, 284, 286; 294/19.1, 19.2

[56] References Cited

U.S. PATENT DOCUMENTS

| | | | |
|---|---|---|---|
| 2,609,198 | 9/1952 | Armstrong | 473/386 |
| 2,979,335 | 4/1961 | Pruitt | 473/285 |
| 3,889,946 | 6/1975 | Setecka | 473/386 |
| 4,589,661 | 5/1986 | Attig | 473/386 |
| 4,951,947 | 8/1990 | Kopfle | 473/386 |
| 4,969,646 | 11/1990 | Tobias | 473/386 |
| 5,116,046 | 5/1992 | Pace | 473/286 |
| 5,171,010 | 12/1992 | Lanoue | 473/386 |
| 5,330,178 | 7/1994 | Geishert, Sr. | 473/386 |
| 5,437,449 | 8/1995 | Zink | 473/408 |
| 5,494,279 | 2/1996 | Ahner | 473/386 |
| 5,540,432 | 7/1996 | Keller | 473/386 |

*Primary Examiner*—Steven B. Wong
*Attorney, Agent, or Firm*—Curtis V. Harr

[57] ABSTRACT

A golf ball teeing device which allows an impaired or elderly golfer to tee a golf ball without the need of bending over, the devices may also be used to retrieve balls from the ground, cup or water hazards. These goals are accomplished by the use of a long handled, golf club-like device with a spring loaded golf ball and tee holding device at its bottom end and a depressable knob at the top end. The golfer uses the device by depressing the knob, which opens the gap between the ball holder and tee holder, thereby allowing a golfer to place a tee and golf ball in the device. The user then places the device in an upright position and pushes the tee at the bottom end of the present invention into the ground, and again depresses the knob, releasing the tee and the ball in their desired position. The golfer may also depress the knob, causing the aforementioned gap to open, and allowing the golfer to place the gap over a golf ball that is on the ground. When the golfer releases the knob, the gap closes, securing the golf ball within the holding device. In this way, the golfer can use the present invention to pick up balls from the ground, cup and to retrieve balls from a water hazard.

4 Claims, 10 Drawing Sheets 20
28
12
22
30
14

GOLF BALL AND TEE PLACING DEVICE

BACKGROUND OF THE INVENTION

The present invention relates to an improvement in the method which a golfer may handle a golf ball without the need to bend over. More specifically, the present invention provides a method in which an elderly golfer, handicapped golfer or a golfer with back problems can simultaneously place a tee into the ground and set a golf ball on top of the tee from a standing position. The present invention also allows a golfer to pick up a tee or ball marker after use while suppling the means to repair a divot. Additionally, the present invention provides a method in which a golfer can pick up a golf ball from the ground, cup or retrieve a ball from a water hazard.

In the past, it was necessary for a golfer to bend at the waist or knees in order to insert a golf tee into the ground and place a golf ball on the tee at each tee box. Although many people enjoy the sport of golf despite various physical limitations, the process of teeing up the ball can cause severe physical pain to some golfers, especially elderly golfers or golfers with back or knee problems. With the gaining popularity of the sport among handicapped people the task of teeing a golf ball may even prove impossible. These golfers may also have difficulty picking up a ball on the green or at various other points on the golf course.

Furthermore, golfers commonly lose golf balls in water hazards, where retrieval is often difficult, if not impossible. Because the price of golf balls continues to increase, losing balls in a water hazard can be costly, as well as frustrating.

Several different types of apparatus for the placement of a golf ball and tee combination have been developed, however they have all suffered from various drawbacks or disadvantages. Two similar such devices are disclosed by the Armstrong U.S. Pat. No. 2,609,198 and the Kopfle U.S. Pat. No. 4,951,947. Both of these patents disclose devices which have inherent disadvantages, first the ball holding mechanism is biased in an upward or open position. This design would be difficult for a user who is incapable of bending to turn the device upside down and place the ball and tee and then turn the device downward for placement of ball and tee combination. Because these holders are both biased in an open position during use it is necessary for the user to forcibly hold a trigger or knob to retain the ball and tee combination during this process, this can be very troublesome for many users. Further, as the force used to place the ball and tee is applied downward through the top of the ball this force must be applied to the upper plunger or trigger in order to push the ball into the ground.

A second type of device is disclosed by the Geishert, Sr. U.S. Pat. No. 5,330,178. This device uses two separate shafts connected by a framework and large handles. Although this device will hold a ball without physical force being applied by the user, due to its size and construction it cannot be used to retrieve balls from the cup. This design further creates the substantial problem of carrying the device, as its double shafted design will not allow it to fit conveniently in a golf bag, thus, necessitating the user to attach the device to the outside of a bag or carrying the device in one's cart.

From the foregoing discussion it can be seen that it would be highly desirable to provide a method of teeing up the ball without the need to bend over and further being able to do so with a tool that will hold a ball until the golfer applies external force to release the ball and tee combination. It also would be desirable to provide a method for picking up a golf ball from a standing position, enabling the golfer to pick up a ball from the ground, as well as from water hazards and the cup.

SUMMARY OF THE INVENTION

It is the primary objective of the present invention to provide a method of teeing up a golf ball without the need to bend over. Additionally, it is an objective of the present invention to provide a method of retrieving a golf ball from a standing position, thereby enabling the golfer to pick up the ball without bending over or to facilitate easier retrieval of a ball from a water hazard.

These objectives are accomplished by the use of a long handled, golf club-like device with a spring loaded golf ball and tee holding device at its bottom end and a depressable knob at the top end. A golfer uses the device by depressing the knob, which opens the gap between the ball holder and tee holder, thereby allowing the golfer to place a tee and golf ball in the device. The user then places the device in an upright position and pushes the tee at the bottom end of the present invention into the ground, and again depresses the knob, releasing the tee and the ball in their desired position.

The golfer may also depress the knob, causing the aforementioned gap to open, and allowing the golfer to place the gap over a golf ball that is on the ground. When the golfer releases the knob, the gap closes, securing the golf ball within the holding device. In this way, the golfer can use the present invention to pick up balls from the ground or cup and to retrieve balls from a water hazard.

For a better understanding of the present invention, reference should be made to the drawings in which there is illustrated and described preferred embodiments of the present invention.

DESCRIPTION OF THE PREFERRED EMBODIMENT

Figure 1:
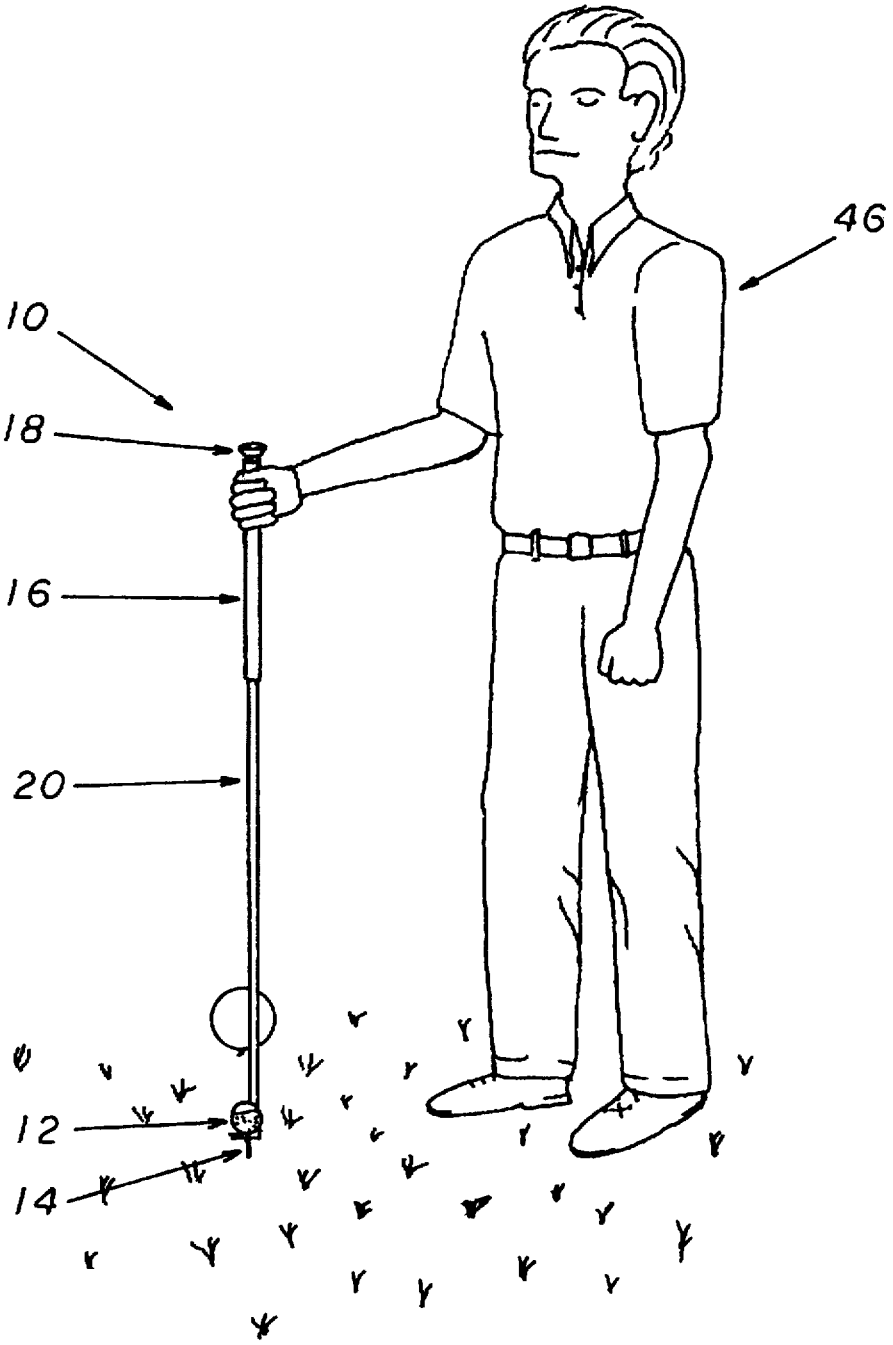
FIG. 1 is a perspective view of the Golf Ball Teeing Device showing the manner in which a golfer uses the devise to tee a golf ball up on a tee box of a golf course.
Figure 2:
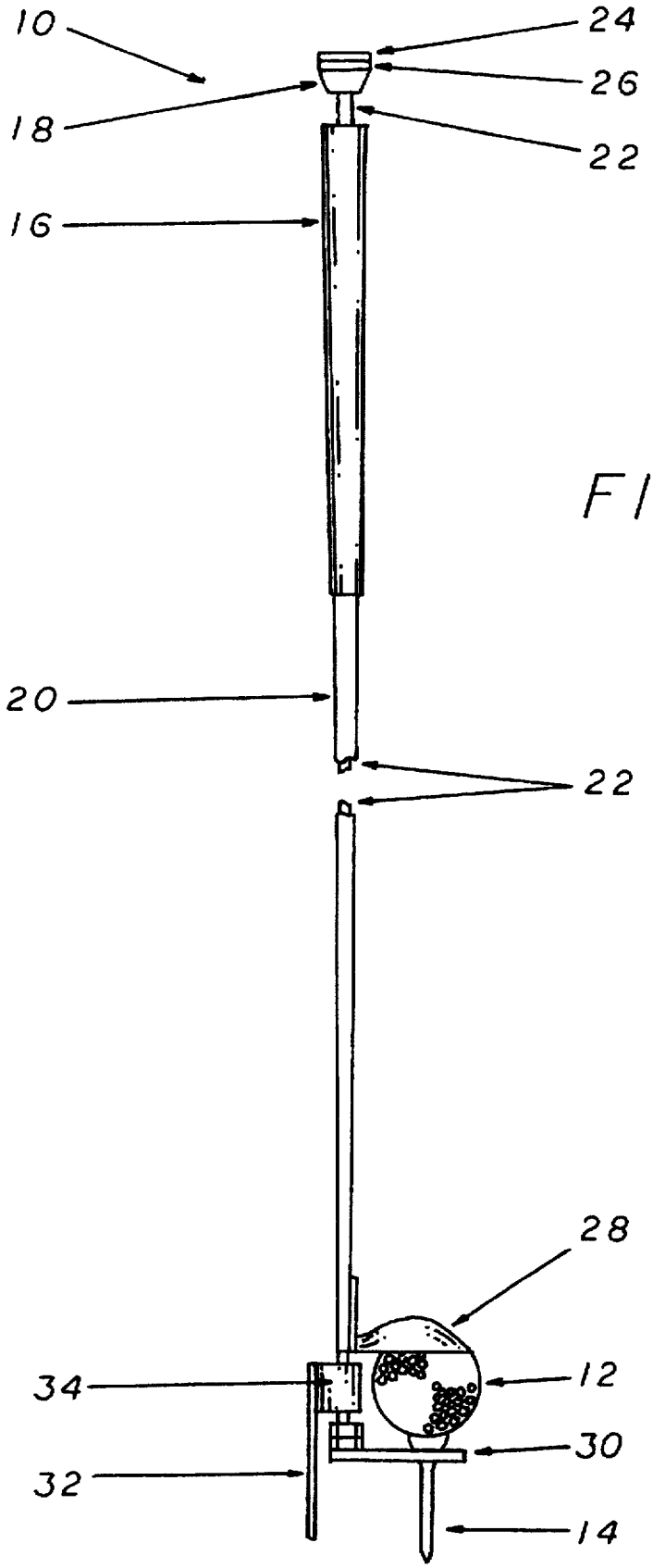
FIG. 2 is a side elevation sectional view of the present invention showing the orientation of its major components to one another.
Figure 3:
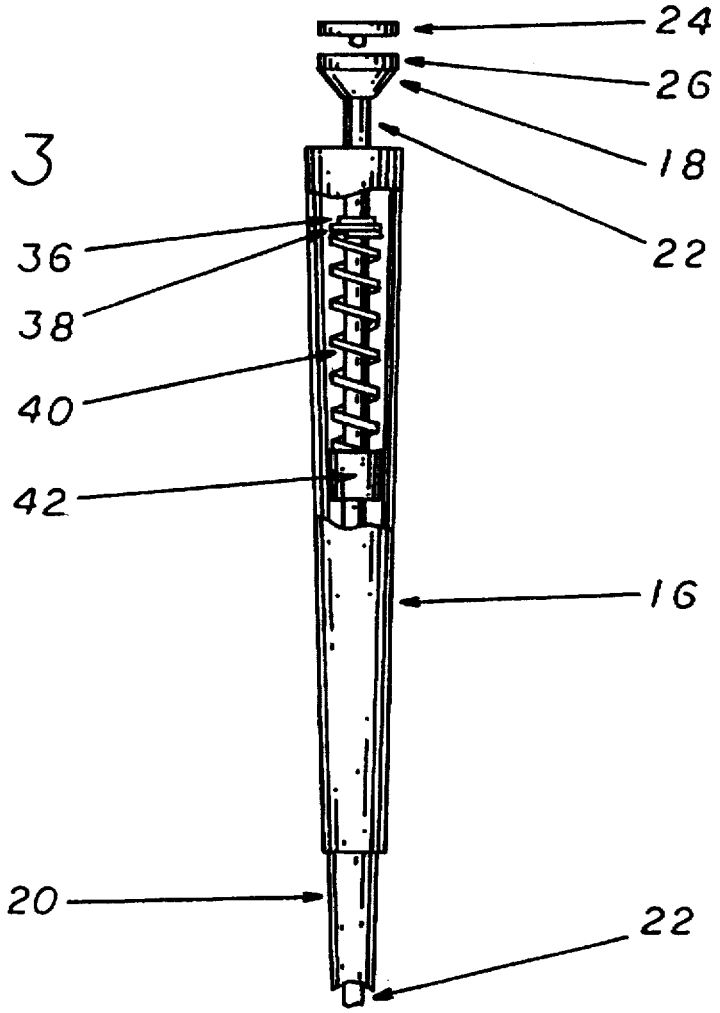
FIG. 3 is a side elevation cut-away view of the upper portion of the present invention showing the manner in which these components fit together and the interior workings of the spring mechanism.
Figure 4:
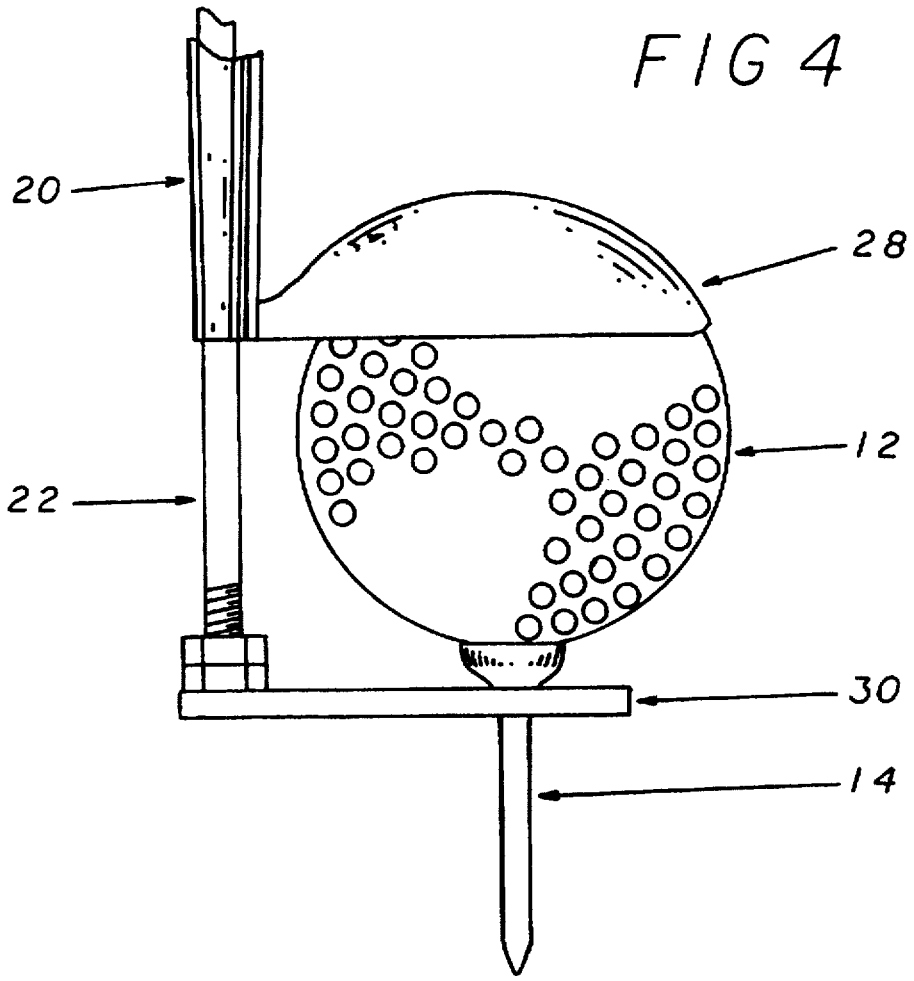
FIG. 4 is a side elevation sectional view of the lower end of the present invention showing the way a golf ball and tee are held within said invention.

Referring now to the drawings, and more specifically to FIG. 1, a golfer 46 uses the Golf Ball Teeing Device 10 by grasping the handle 16, located directly below the release knob 18, and pushing the golf tee 14 into the ground through the outer shaft 20. By releasing the Golf Ball Teeing Device 10, the golfer 46 has teed up the golf ball 12 without the necessity of bending over, thus saving fatigue to his lower back or knees.

FIGS. 2, 3, 4, 5 and 6 depict the manner and mechanisms by which the present invention grasps, holds and releases the golf ball 12 and golf tee 14. The body of said invention is constructed by the use of an outer shaft 20 and an inner shaft 22. At the uppermost end of the outer shaft 20 is located the handle 16, which fits snugly over the outer shaft 20. The outer shaft 20 extends downward to a lower end where the ball holder 28 is fixedly attached in a position perpendicular to shaft 20. The illustrated ball holder 28 is a split style cup however a solid or one piece cup would function equally.

The inner shaft 22 longitudinally passes through and extends beyond at both its upper and lower ends the outer shaft 20. At the uppermost end of the inner shaft 20 is located the release knob 18, which has attached to it a magnet 26, to which the ball marker 24 attaches. The lowermost end of the inner shaft 22 is attached to the tee holder 30 which extends at a right angle from the inner shaft 22, and lies parallel to the lower surface of the ball holder 28.

Figure 5:
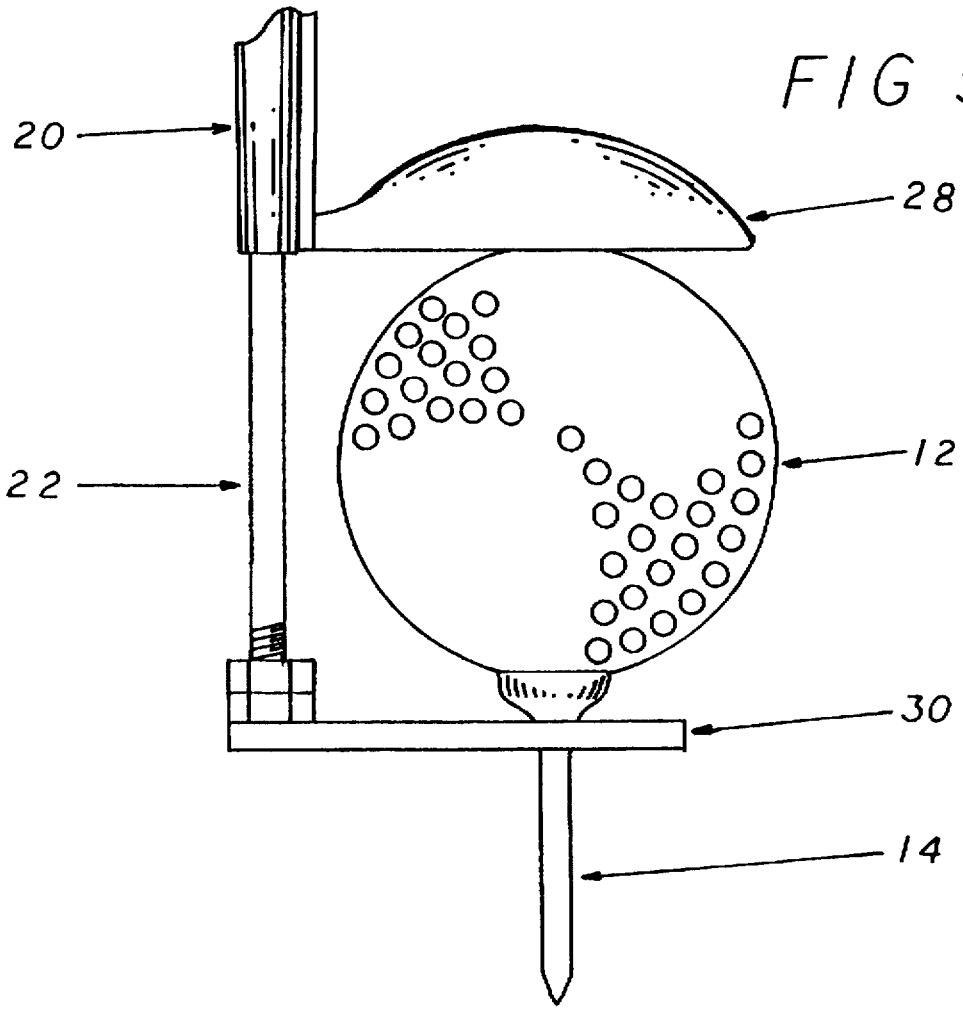
FIG. 5 is a side elevation sectional view of the lower end of the present invention showing the result of engaging the spring mechanism, and thus, releasing the golf ball and tee from said invention.
Figure 6:
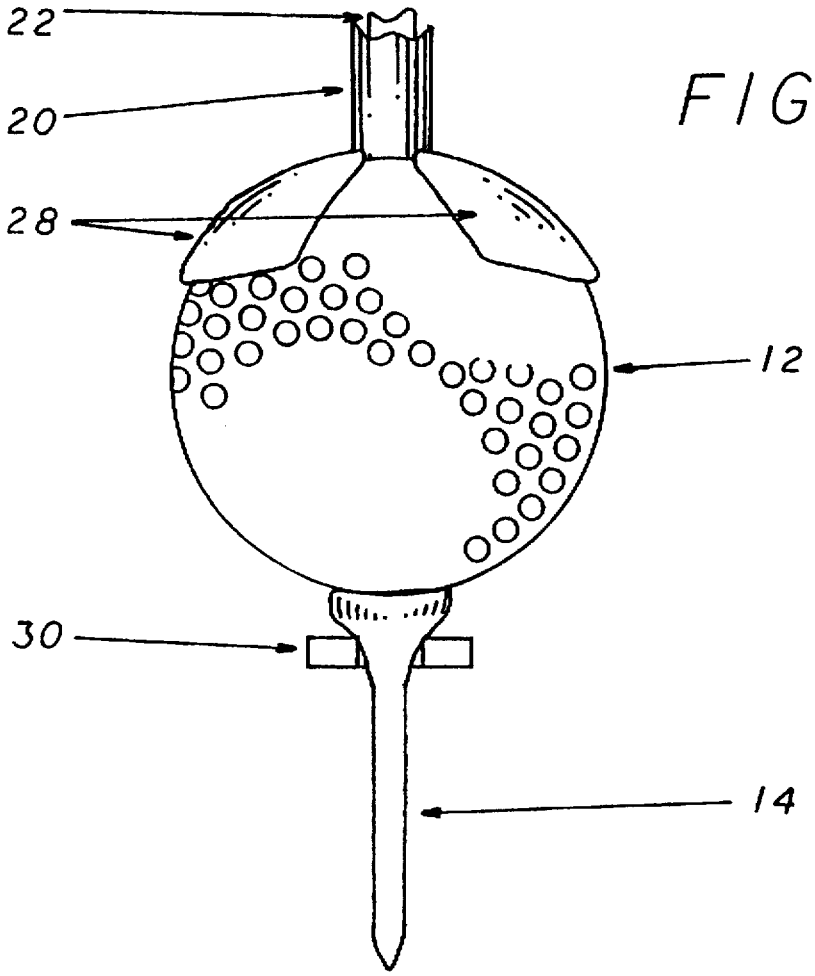
FIG. 6 is a front elevation sectional view of the lower end of the present invention, again showing the way a golf ball and tee are held within said invention while using the cup shaped ball holder.
Figure 7:
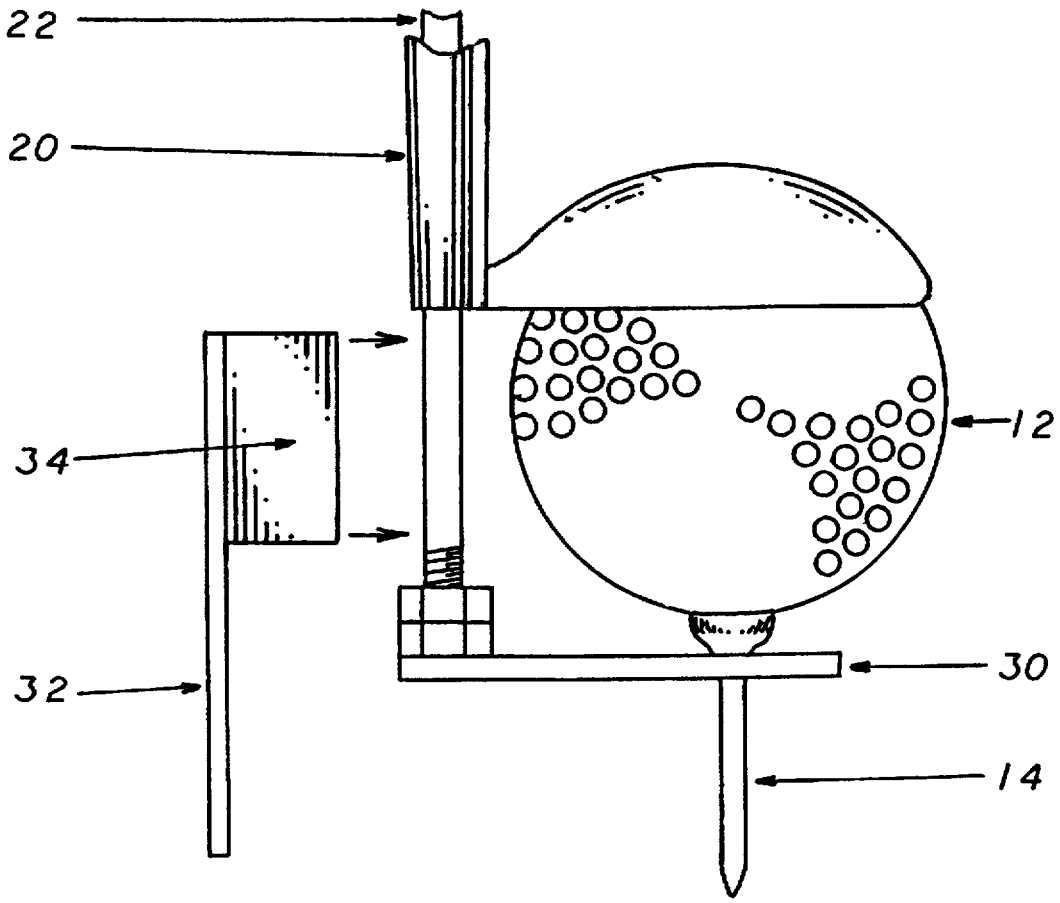
FIG. 7 is a side elevation sectional view of the lower end of the present invention showing the manner in which the greens keeper accessory is attached to said invention.
Figure 8:
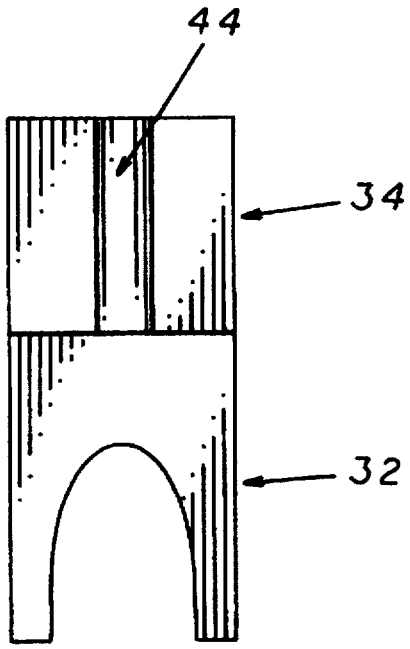
FIG. 8 is a front elevation view of the greens keeper accessory showing the manner in which it is constructed.
Figure 9:
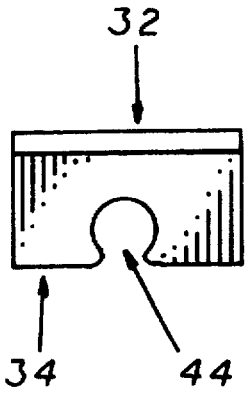
FIG. 9 is a top elevation view of the greens keeper accessory showing the construction of the snap groove by which it attaches to the present invention.

Within the cavity created between the outer shaft 20 and the inner shaft 22 is located the release spring 40. The release spring 40 is held in place to the outer surface of the inner shaft 22 by the use of the keeper 38 and washer 36. The lower end of the release spring 40 is held in place by use of the ring-shaped bushing 42, which is frictionally mounted to the inner surface of the outer shaft 20. When the release knob 18 is not engaged and when a golf ball 12 and golf tee 14 are placed between the ball holder 28 and the tee holder 30, the release spring 40 creates upward pressure on the inner shaft 22, which in turn creates the same upward pressure on the tee holder 30, thus holding the golf tee 14 and golf ball 12 securely in place within the Golf Ball Teeing Device 10. Conversely, when force is applied to the release knob 18, compressing the release spring 40, the tee holder 30 is forced downward in relation to the body of the present invention. This action releases the holding pressure on the golf ball 12 and golf tee 14, allowing the golfer 46 to remove the present invention from the golf ball 12 and golf tee 14 after properly teeing the golf ball 12. (FIG. 5 shows the present invention 10 and golf ball 12 in the release configuration.) The tee holder 30 of the present invention may be provided with a beveled edge about the inner slot for ease in gripping the tee.

FIGS. 2, 7, 8 and 9 show an available accessory of the Golf Ball Teeing Device 10, the attachable greens keeper 32. The greens keeper accessory 32 is attached to the Golf Ball Teeing Device 10 by snapping it to the exposed part of the inner shaft 22 just below the ball holder 28 and above the tee holder 30. The accessory is made up of the greens keeper 32 which is attached to the greens keeper holder 34 which on its inner surface has a snap groove 44 which fits over the inner shaft 22. This allows the golfer 46 to repair ball marks left on the green without the need to bend over by attaching the greens keeper 32 to the lower portion of the present invention.

Figure 10:
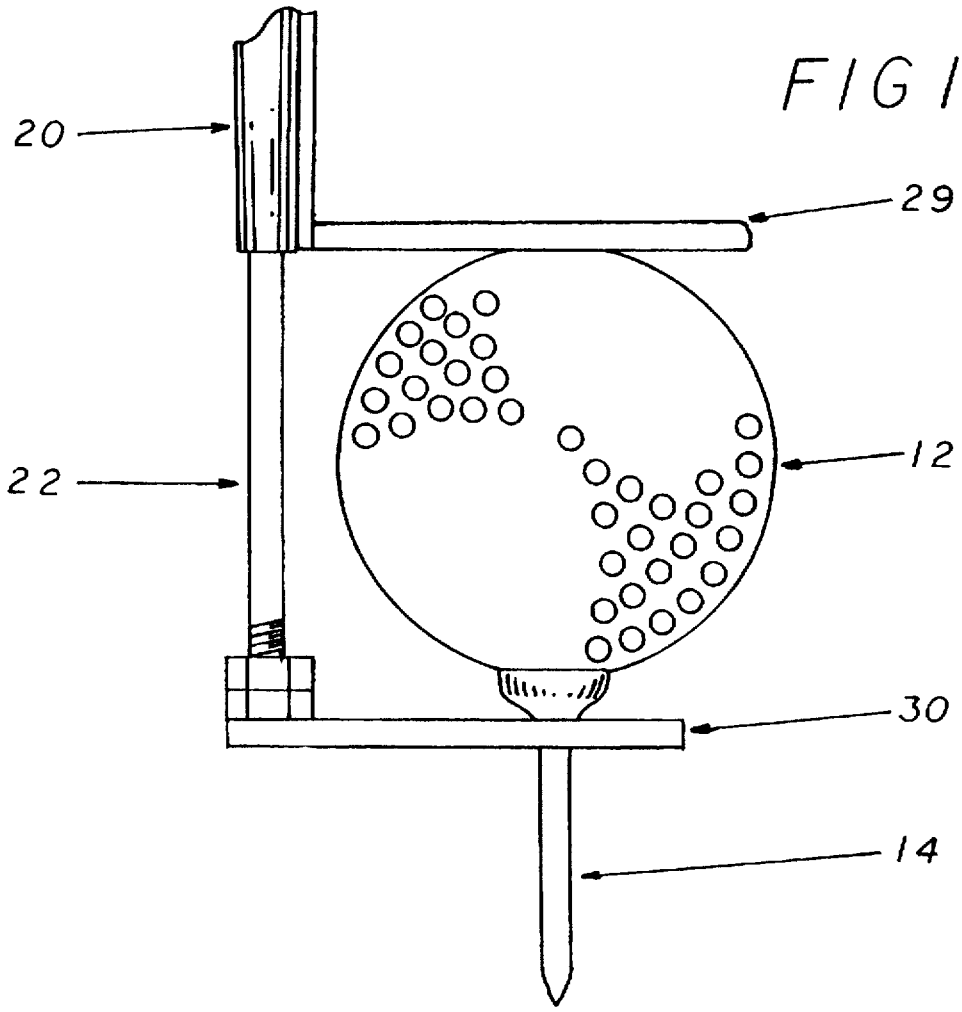
FIG. 10 is a side elevation sectional view of the lower end of the present invention showing the result of engaging the spring mechanism, and thus, releasing the golf ball and tee from said invention. This figure also illustrates the use of a ring style ball holder.
Figure 11:
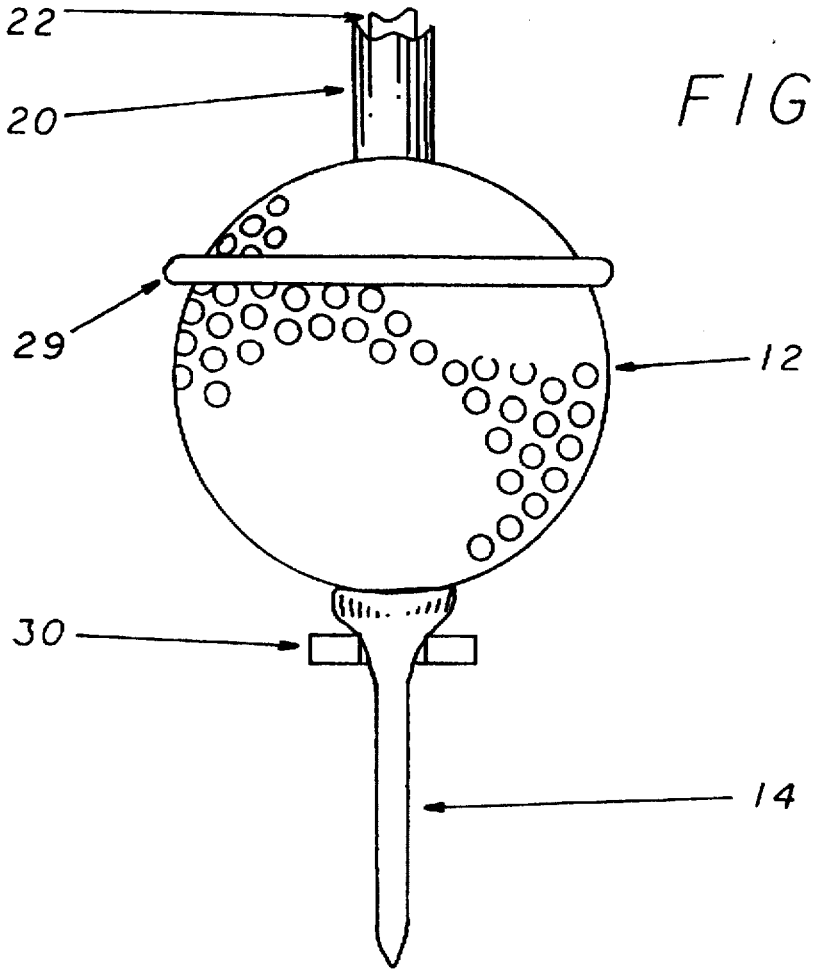
FIG. 11 is a front elevation sectional view of the lower end of the present invention, again showing the way a golf ball and tee are held within said invention while using the ring style ball holder.

FIGS. 10 and 11 illustrate the use of a ring style ball holder 29. FIG. 10 shows the position of the ring style ball holder in the golf ball 12 in the open or released position. FIG. 11 shows the position of the ring style ball holder and the golf ball 12 in the closed or held position.

Although the present invention has been described in considerable detail with preference to certain preferred versions thereof, other versions are possible. For example the ball holder may be a split cup, a solid cup or a ring style holder. Therefore, the spirit and scope of the appended claims should not be limited to the description of the preferred versions contained herein.

What is claimed is:

1. A golf ball teeing device comprising:

An elongated hollow outer golf club shaft having an upper end portion and a lower end portion said shaft including an inner and outer surface;

A sleeve shaped shaft conforming golf club type golf grip placed about the outer upper portion of said outer shaft;

A cup shaped ball holder fixedly attached to the lower end of said outer shaft, said ball holder extending perpendicular from said lower end of said outer shaft in a cup down position;

An elongated inner shaft which is longitudinally slidable through said hollow outer shaft, said inner shaft having an upper end which extends beyond the upper portion of said outer shaft and a lower portion which extends beyond the lower end of said outer shaft;

A tee holder having a slot wide enough to allow the shank of a tee to pass through but which will not permit the head of a tee to pass through, said tee holder being fixedly mounted perpendicular to said inner shaft at the lower portion in a position directly below said ball holder;

An elongated spring mounted inside the upper portion of said hollow outer shaft so as to be completely concealed during normal use in a manner that upwardly biases said inner shaft within said outer shaft, said elongated spring having an upper and lower end;

A rind shaped bushing frictionally mounted to said inner surface of said hollow shaft said bushing acting as stop and to connect said lower end of said spring to said inner surface of said hollow shaft; and A washer means about said inner shaft for connecting said upper end of said spring to said inner shaft.

2. A golf ball teeing device as in claim 1 further comprising a knob on the upper portion of said inner shaft said knob having a magnet and a golf ball marker.

3. A golf ball teeing device as in claim 2 further comprising a greens repair tool removably attached to the lower portion of said inner shaft via clip channel on the back of said greens repair tool.

4. A golf ball teeing device as in claim 1 wherein said cup shaped ball holder is replaced by a ring shaped ball holder.

* * * * *